United States Patent [19]

Jasper, Jr.

[11] Patent Number: 4,760,769

[45] Date of Patent: Aug. 2, 1988

[54] HIGH-POWER, RAPID FIRE RAILGUN

[75] Inventor: Louis J. Jasper, Jr., Ocean, N.J.

[73] Assignee: The United States of America as represented by the Secretary of the Army, Washington, D.C.

[21] Appl. No.: 43,270

[22] Filed: Apr. 27, 1987

[51] Int. Cl.[4] ..... F41F 1/02

[52] U.S. Cl. ..... 89/8; 124/3; 310/12

[58] Field of Search ..... 89/8; 124/3, 54; 310/12; 318/135

[56] References Cited

U.S. PATENT DOCUMENTS

| | | | |
|---|---|---|---|
| 4,369,692 | 1/1983 | Kemeny | 89/8 |
| 4,433,607 | 2/1984 | Kemeny | 89/8 |
| 4,651,024 | 3/1987 | Hickey | 89/8 |

*Primary Examiner*—Stephen C. Bentley

*Attorney, Agent, or Firm*—Sheldon Kanars; John T. Rehberg

[57] ABSTRACT

A rapid-fire electromagnetic projectile launcher. The invention features two parallel disks with gaps in their peripheries. A voltage source is applied to the disks to cause current to flow in opposite directions through the disks, generating a strong repulsive force which is utilized to eject a projectile. A rotator is positioned concentric with the disks to control timing of the repulsive action and facilitate projectile reloading.

6 Claims, 4 Drawing Sheets

HIGH-POWER, RAPID FIRE RAILGUN

The invention described herein may be manufactured, used, and licensed by or for the Government for governmental purposes without the payment to me of any royalty thereon.

TECHNICAL FIELD

This invention relates generally to guns and projectile launchers and more particularly to devices which launch bullets or projectiles by utilizing electromagnetic energy instead of chemical propellants.

BACKGROUND OF THE INVENTION

Conventional guns and projectile launching weapons utilize the burning of chemical propellants to achieve high projectile velocities. In recent years there has been a renewed interest in projectile launchers which utilize electromagnetic energy. Generally speaking, electromagnetic launchers promise higher projectile velocities than launchers utilizing chemical propellants. Furthermore, electromagnetic launchers reduce logistic problems because the storing and transportation of propellant materials is not required. In addition, electromagnetic launchers have potentially greater fire power and increased system survivability (reduced probability of explosion).

One prior art design currently receiving considerable attention is the electromagnetic railgun. A conventional prior art electromagnetic railgun utilizes two long parallel rails capable of carrying large current. A sliding, conducting armature is positioned between the two rails. The armature is adapted to slide between the two rails along their entire length. Application of a voltage across two ends of the two rails causes a large current pulse to flow through one rail, thence through the armature, and into the other rail. The current generates a magnetic field. The Lorentz force created by the interaction of the magnetic field with the current in the armature causes the armature to be propelled between the two rails in a direction away from the points of application of the voltage. The armature itself may be projected like a bullet at a target, or the armature may be used to push a bullet-type projectile at high velocity towards a chosen target, and the armature ultimately slowed and retained with the device for future shots. A discussion of conventional prior art electromagnetic railguns is contained in applicant's copending application, titled "Electromagnetic Injector/Railgun," Ser. No. 910,915, Filed Sept. 22, 1986, the entire disclosure which is hereby incorporated by reference.

It is obviously desirable for a railgun to be capable of rapid-fire operation. A known prior art device utilizes a high-power rapid fire switch between the railgun and the power source. The switch makes it possible to fire many shots within a short period of time. The switch has two parallel conductive circular disks with a rotating arm sandwiched between them. Each disk has a gap in its periphery. The arm makes simultaneous electrical contact with both disks. Application of a voltage across the two circular disks generates a Lorentz force which causes the arm to rotate between the disks. The periphery of each disk is also connected to one of two rails of a conventional railgun. As the self-propelled arm passes the connection between the disks and the railgun, current is delivered to the railgun and the projectile is launched between the rails of the railgun. Thus, the railgun fires each time the arm passes the connection point between the disks and the railgun. The firing rate of the railgun is governed by the speed of the rotating arm.

Another rotary switch suitable for providing railgun power is disclosed in U.S. Pat. No. 4,433,607, entitled "Switch For Very Large D.C. Currents" issued to Kemeny.

Those concerned with the development of high power rapid fire projectile launchers have long recognized the need for compact, lightweight components.

Known prior art high-power rapid fire switches can deliver approximately 1.5 megAmperes of current and weigh approximately one thousand pounds and are 36 inches in diameter. The switch must be coupled to the railgun itself and the combination is bulky, massive, and complex.

SUMMARY OF THE INVENTION

The present invention features an integral railgun and rapid fire switch. The disks of the rapid fire switch may serve simultaneously as the rails of the railgun in some embodiments. Furthermore, the projectile is launched perpendicular to the disks (rails) instead of parallel to the rails (as in a conventional railgun). Thus, the present invention provides a simple, light, compact projectile launcher capable of rapid-fire operation.

The invention has two parallel circular disks. Both disks have gaps in their peripheries. One of the disks has a hole or recess for holding a close-fitting metallic bullet. A voltage source is connected across both disks. The device operates upon the principle that currents flowing in opposite direction through two parallel conductors (i.e. the two disks) create a force which tends to drive those conductors apart. Thus, current is caused to flow through one of the disks in a clockwise direction, and through the other disk in a counterclockwise direction. Force generated between the disks cause the bullet to be ejected away from the disks toward a chosen target.

A pair of coupled, self propelled rotating arms sandwiched between the disks creates (and breaks) the necessary electrical connections between the disks which cause the aforementioned oppositely directed current flows necessary for bullet ejection. Each revolution of the self-propelled pair of arms produces a current pulse which ejects another bullet.

Accordingly, it is an object of the present invention to provide a projectile launcher which does not require a chemical propellant.

Another object of the present invention is to provide simple, compact projectile launcher.

A further object of the present invention is to provide a compact electromagmetic projectile launcher with rapid-fire capability.

A still further object of the present invention is to provide a compact, lightweight gun capable of shooting bullets at high speed.

Yet another object of the present invention is to provide an electromagnetic projectile launcher with an integral high power, rapid-fire switch.

BRIEF DESCRIPTION OF THE DRAWINGS

The invention will be more fully appreciated from the following detailed description when the same is considered in connection with the accompanying drawings, in which.

DETAILED DESCRIPTION OF THE PREFERRED EMBODIMENTS

Figure 1A:
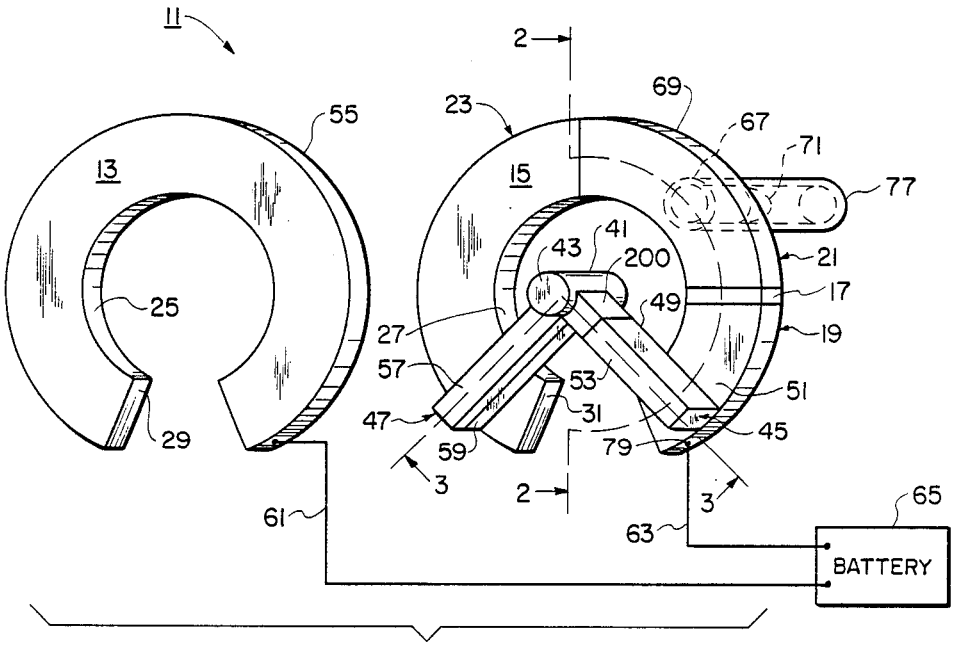
FIGS. 1A and 1B are perspective views of the inventive device.
Figure 1B:
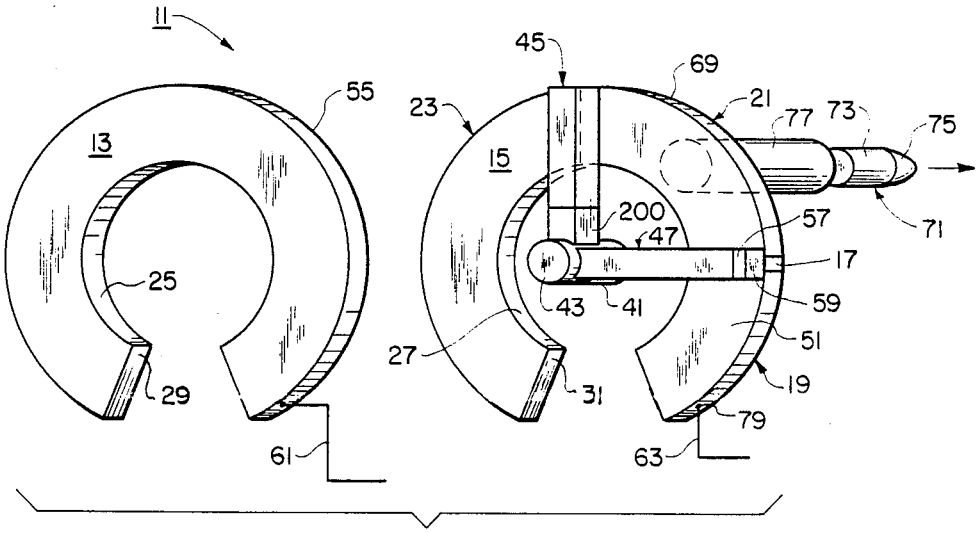

Referring to the drawings, and particularly FIGS. 1A and 1B, wherein like numeral refer to like components throughout, reference numeral 11 designates generally the inventive device. Disks 13 and 15 are parallel to one another. (FIGS. 1A and 1B show the disks separated somewhat for clarity). Disk 13 may be made of conductive material such as copper or a copper-tungsten alloy. Disk 15 contains both insulating portions and conductive portions. The conductive portions of disk 15 are designated by reference numerals 19 and 21. Conductive portions 19 and 21 may be made from copper or a copper-tungsten alloy capable of carrying large currents. Insulator 17 completely separates the two conductive portions, 21 and 19. It is not possible for current to flow directly from portion 19 of disk 15 to portion 21 of disk 15 because the current path is blocked by insulator 17. Furthermore, disk 15 has an additional, larger, insulator 23. Thus, the conductive portions of disk 15 are designated by reference numerals 19 and 21, while the nonconductive portions are designated reference numerals 17 and 23. It should be noted that insulator 17 is a relatively narrow piece of insulating material which separates conducting portion 19 from conducting portion 21. However, insulator 23 is a relatively large, curved piece of insulating material which may constitute a substantial portion of disk 15. Both disks 13 and 15 have holes 25 and 27 respectively in their centers. Both disks 13 and 15 also have respective gaps 29 and 31 which extend from holes 25 and 27 respectively to the outer edges of disks 13 and 15. The disks are positioned, as mentioned before, concentrically so that hole 25 is in registration with hole 27.

Rotator 41 has a generally cylindrical hub 43 and two arms 45 and 47. Hub 43 is positioned so that it is concentric with disks 13 and 15. Arms 45 and 47 extend outward from hub 43. Arms 45 and 47 are positioned so that they fit between disks 15 and 13, contacting both of them. That is, as shown is FIGS. 1A and 2A, the lower surface 49 of arm 45 contacts the upper surface of disk 15 and the upper surface 53 of arm 45 contacts the lower surface 55 of disk 13. Thus, arm 45 being made of conductive material, is capable of completing a current path which extends from conductive portion 19 of disk 15 through arm 45, and thence through disk 13.

Figure 3:
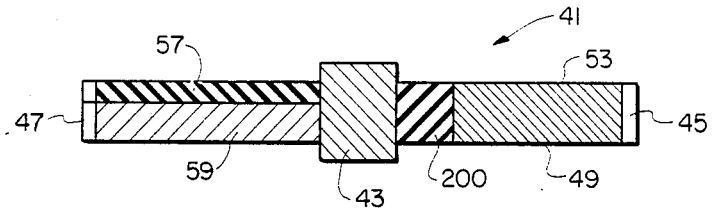
FIG. 3 is a cross sectional view of the arm depicted in FIG. 1A cut along the lin 3—3 and looking in the direction of the arrows.

Similarly, arm 47 is sandwiched between disks 13 and 15, contacting both of them. However, as can be clearly appreciated from the cross-sectional view of FIG. 3, arm 47 has an insulator 57 upon its upper surface and a conductor 59 along its lower surface. Thus, arm 47, althouqh it is positioned between and contacts both disk 15 and disk 13, cannot carry current between the disks because of the presence of insulator 57.

Furthermore, as will soon be appreciated, it is essential that current be prevented from flowing from conductor 59 of arm 47 through hub 43 and into arm 45. Insulator 200, between arm 45 and hub 43 prevents the above-mentioned current flow. Alternatively, hub 43 may be made from insulating material (and arm 45 entirely of conductive material).

Both arms 45 and 47 are fixed with respect to hub 43. That is, the angular span between arms 45 and 47 cannot change. However, hub 43 is free to rotate about its concentric position between disks 13 and 15. For example, FIG. 1B illustrates the inventive device with rotator 41 at a slightly different position.

The device 11 is energized by connecting disk 13 and conductive portion 19 of disk 15 via respective leads 61 and 63 to a power source 65. The power source 65 may be any source, such as a battery or battery/capacitor combination or homopolar generator. The power source 65 may also include an on-off switch.

Conductive portion 21 of disk 15 has a recess 67 cut on its underside 69. Recess 67 is on the side of disk 15 which is *not* contacted by arms 45 and 47 of rotator 41. Recess 67 is sized to admit a projectile or bullet 71. The projectile 71 has a metallic base 73 and an optional header 75 which need not be metallic. It is necessary that projectile 71 fit closely within recess 67, so that any current which passes through conducting portion 21 of disk 15 also passes through the metallic portion 73 of projectile 71. An insulating barrel, 77, to guide projectile 71 towards a target, may be affixed to the underside 69 of disk 15.

Figure 2A:
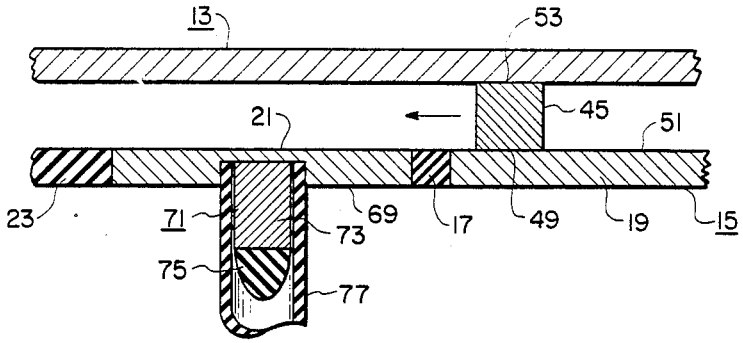
FIGS. 2A–D are cross sectional views of the device of FIG. 1A cut along the dotted line and looking in the direction of the arrows.

Operation of the inventive device is easily understood with reference to FIGS. 1A–B and 2A–D. In FIG. 1A, arm 45 contacts conductive portion 19 of disk 15 and also contacts disk 13. Current from power source 65 flows through conductor 63, into conductive portion 19 of disk 15, thence through arm 45, into disc 13, through conductor 61, and back to power source 65. The current flow creates a Lorentz force which moves rotator 41 in a counter-clockwise direction. FIG. 2A is a cross-sectional view corresponding generally to FIG. 1A. In FIG. 2A, arm 45 moves to the left between disks 13 and 15.

Figure 2B:
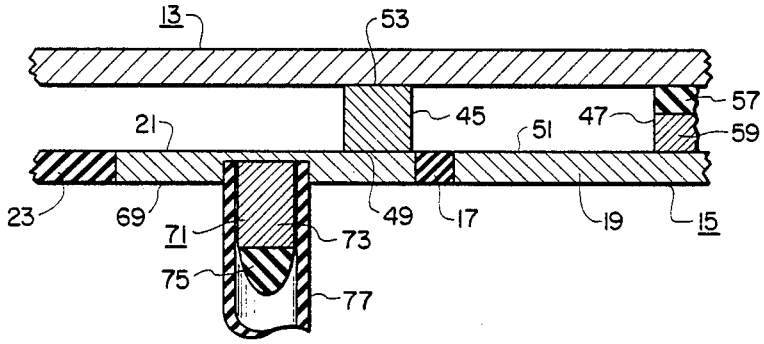

As arm 45 continues its counter-clockwise movement, it passes over insulator segment 17. Because insulator segment 17 completely separates conductive portions 19 and 21 of disk 15, current flow through the device is interrupted as soon as arm 45 moves past insulator segment 17. FIG. 2B illustrates arm 45 just after it has passed insulator segment 17. Of course, arm 47, being an integral part of rotator 41, also rotates in a counter-clockwise direction at a fixed angular distance behind arm 45. The illustration of FIG. 2B shows the leading edge of arm 47 as it contacts conductive portion 19 of disk 15. The presence of insulator 57 on arm 47 prevents any current flow between disk 13 and conductive portion 19 of disk 15. Consequently, as mentioned before, when arm 45 is in the position depicted in FIG. 2B, (i.e., immediately beyond insulator 17) all current flow through the device has ceased. However, the angular momentum generated by the impulse created by the aforementioned Lorentz force causes rotator 41 with arms 45 and 47 attached to continue its counter-clockwise motion.

Figure 2C:
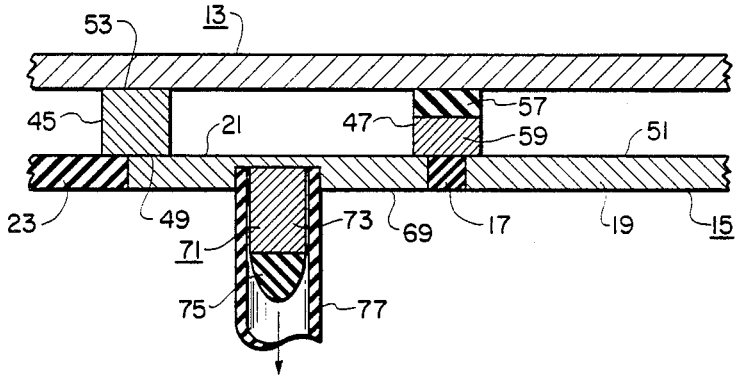

Ultimately, rotator 41 reaches the position depicted by FIGS. 1B and 2C. In FIG. 1B arm 45 is near the 12-o'clock position, in contact with conductive portion 21 of disk 15. Arm 47 straddles insulator segment 17. The relative positions of arms 45 and 47 can also be clearly seen in FIG. 2C. It is essential that the angle between arms 45 and 47 be constructed so that arm 47 effectively straddles insulator 17 (i.e. contacts conductive portion 19 *and* conductive portion 21 simultaneously) while arm 45 still maintains contact with conductive portion 21. In the position depicted by FIG. 1B, current again flows through the device. Current flows from power source 65 through lead 63, and through conductive portion 19. Conductor 59 of arm 47 provides a path which permits the current to jump over insulator segment 17 by flowing from conductive portion 19 through conductor 59 to conductive portion 21. The current continues from conductive portion 21 through arm 45, thence through disk 13 and lead 61 back to power source 65. Of course, the presence of insulator 57 prevents arm 47 from creating a short circuit between disks 15 and 13.

Figure 2D:
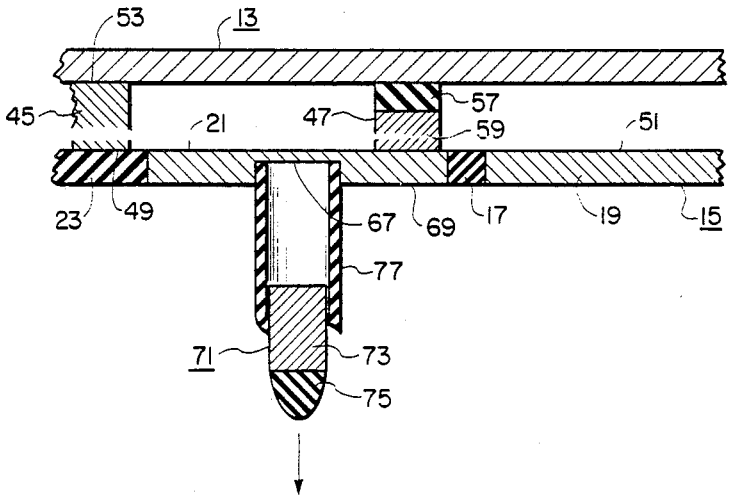

Thus, the general direction of current flow through disk 15 is counter-clockwise, while the general direction of current flow through disk 13 is clockwise. The oppositely-directed current flowing through parallel conductors 15 and 13 creates a powerful repulsive force which serves to eject projectile 71 from recess 67. Furthermore, the above-described current path provides another Lorentz-force impulse which drives rotator 41 counter-clockwise again from the position depicted in FIG. 1B. Current flow through the device ceases when arm 47 no longer straddles insulator segment 17 and arm 45 contacts insulator 23 of disk 15. However, the angular momentum of rotator 41 causes continued counter-clockwise rotation of arms 45 and 47 until the starting position depicted by FIG. 1A is again reached and the cycle may be repeated again. FIG. 2D simply depicts projectile 71 as it leaves recess 67 while arm 47 has passed beyond, and no longer straddles insulator 17.

Of course, after projectile 71 has been ejected, it is necessary to reload the device for another shot. Ideally, the device should be re-loaded every cycle so that it can be fired every cycle. After arm 45 contacts insulator 23 of disk 15 (i.e. after arm 47 proceeds slightly past the position depicted in FIG. 2D) current flow through the device ceases and another projectile may be inserted in recess 67. (Of course, if there were still oppositely-directed current flow between disks 15 and 13, any attempt to insert a projectile into recess 67 would be met with dramatic failure).

There are a variety of methods, well known to those skilled in the art, for introducing a bullet or projectile into a weapon chamber between shots. A spring-loaded magazine with, perhaps, pneumatic or mechanical guide means to direct projectiles into recess 67 would be suitable.

Figure 4:
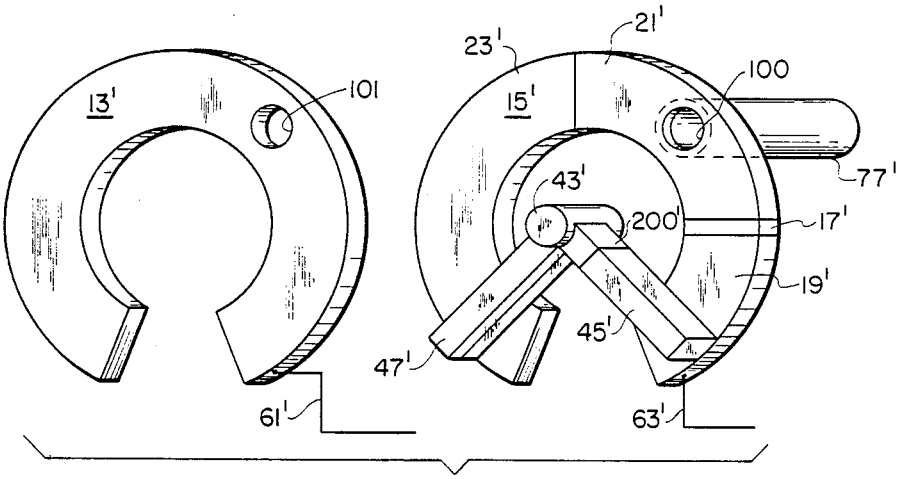
FIG. 4 is a perspective view of an alternative embodiment of the present inventive device.

FIG. 4 illustrates an alternative embodiment of the present invention. In FIG. 4, disk 13' has a hole 101 in registration with a corresponding hole 100 in disk 15'. During the loading phase (i.e. when arm 45' is in contact with insulator 23') a projectile may be introduced from the left of disk 13', through hole 101 thence through hole 100 and into barrel 77'. Thus, the projectile will be waiting within barrel 77' at the moment of firing analagous to that shown in FIG. 1B. The projectile may be injected by pneumatic or mechanical means.

In both of the disclosed embodiments it is necessary to mechanically secure both disks 13 and 15 (or 13' and 15') so that they do not fly apart when oppositely-directed currents begin to flow.

Figure 5:
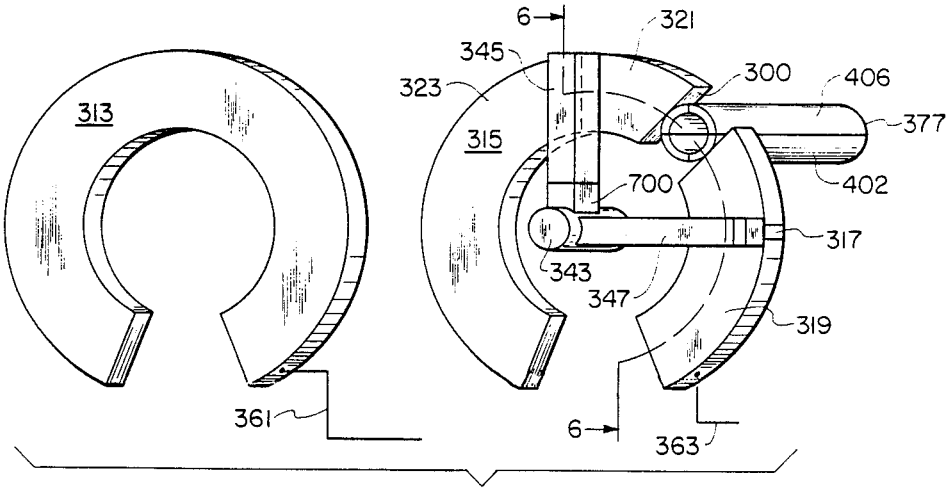
FIG. 5 is a perspective view of another alternate embodiment of the present invention.
Figure 6A:
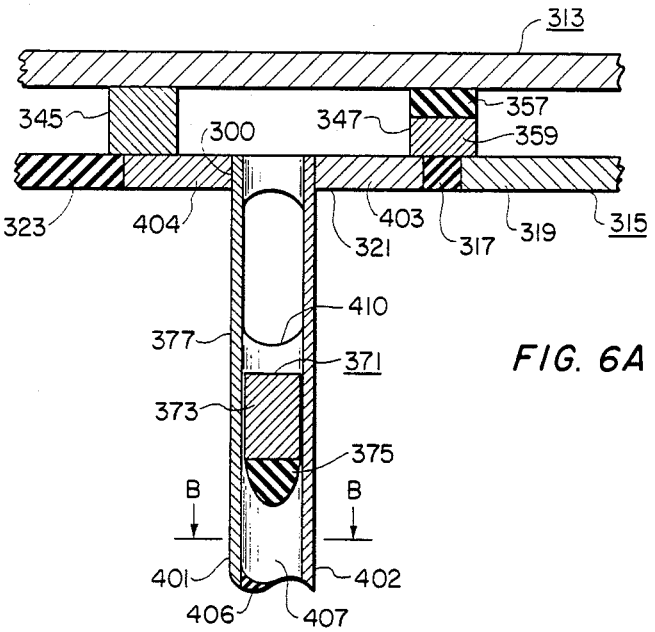
FIG. 6A is a cross-sectional view of the device of FIG. 5 cut along the dotted line and looking in the direction of the arrows.
Figure 6B:
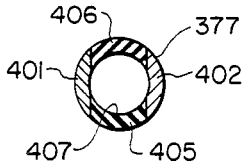
FIG. 6B is a cross-sectional view of the device of FIG. 6A cut along the dotted line and looking in the direction of the arrows.

Another embodiment of the present inventive device is illustrated in FIGS. 5 and 6A–B. The device depicted by FIG. 5 is analogous to the devices of FIGS. 1–4. However, recess 67 of FIGS. 1A–B and hole 100 of FIG. 4 have been replaced by gap 300 which severs conductive portion 321 of disk 315. Rotator 343 with arms 347 and 345 is constructed in a manner and operates similarly to rotator 41 of FIGS. 1A–B. However, barrel 377 which fits within gap 300 is composed of both conductive and insulating portions. Barrel 377 has two opposed metallic rails 401 and 402. Rail 402 is connected to conductive segment 403 of conductive portion 321 of disk 315. Rail 401 is connected to conductive segment 404 of conductive portion 321 of disk 315. Rail portions 401 and 402 are separated by insulating segments 405 and 406. Metallic portions 401 and 402 together with insulator segments 405 and 406 together form barrel 377 with hole 407 for admitting a projectile 371. Projectile 371 is composed of a generally cylindrical metallic portion 373 with an insulating of header 375.

The firing sequence of the device depicted in FIG. 5 is similar to that illustrated in FIGS. 2A–D. Arm 345 has an insulator 700 similar to insulator 200 in FIG. 3. When arm 345 passes hole 300 while conductive portion 359 of arm 347 straddles insulator 317, current flows through conductors 319, 359, 403, barrel 402, conductive portion 373 of projectile 371, and conductors 401, 404, 345, and 313. Thus, as in the sequences already disclosed in detail in FIGS. 2A–D, oppositely directed current paths are formed through disks 313 and 315 and projectile 371 via the conductive portions 401 and 402 of barrel 377. Conductive portions 401 and 402 of barrel 377 serve somewhat like the rails of a conventional railgun.

Conductive portions 401 and 402 of barrel 377 should be contoured to provide a close fit with the metallic portion 373 of projectile 371. A hole 410 may be located within one of the insulating portions 406 or 405 of barrel 377 to facilitate loading of projectile 371. Alternatively, loading may be accomplished via a hole in disk 313 in a manner analagous to that depicted in FIG. 4.

Of course, it necessary that the spacing of insulating portions 323 and 317 of disk 315 together with the size and angular displacement between arms 347 and 345 of rotator 343 be synchronized so that current is continuously fed through conductive portion 373 of projectile 371 during the entire time that projectile 371 travels through barrel 377. In addition, the inductance and resistance of the entire device will affect both the rise and fall time of the current pulse.

Figure 7:
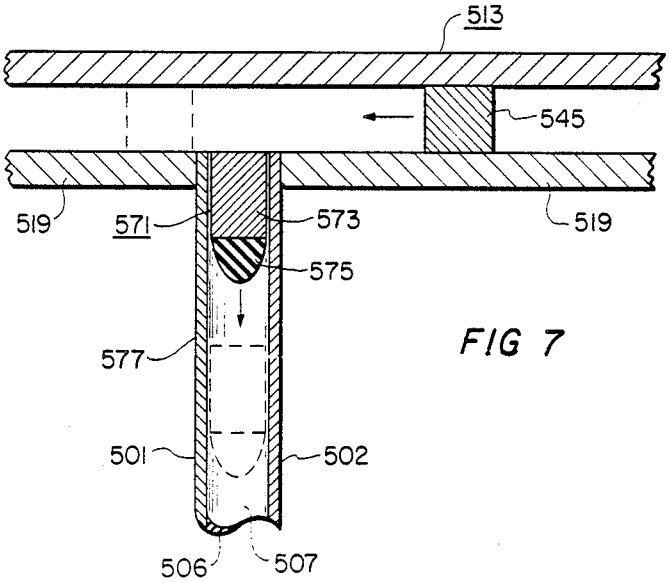
FIG. 7 is a cross-sectional view of another alternative embodiment of the present invention.

Finally, the device shown in cross-section in FIG. 7 represents a simplification of the device shown in FIGS. 5 and 6A–B. The device of FIG. 7 is similar to the device depicted in FIG. 6A, except that insulator 317 and arm 347 have been removed. The device of FIG. 7 functions with only one conductive arm 545 attached to a rotating hub between parallel disks 513 and 519. Both disks 513 and 519 may be made completely of conductive material to the right of barrel 577. Barrel 577 is attached to disk 519. Barrel 577 is composed of two conductive (501, 502) and two insulating portions, similar to barrel 377 of FIG. 6A. (Only insulating portion 506 is shown for clarity). When conductive arm 545 is positioned to the right of barrel 577, as shown is FIG. 7, current flows from the power source through disk 513, through conductive arm 545, thence through disk 519 and back to the power source. After arm 545 moves to the left of barrel 577, as shown by the phantom outline in FIG. 7, current flows through disk 513, arm 545, rail 501, conductive portion 573 of bullet 571, rail 502, and thence through disk 519 to the power source. Bullet 571 emerges through hole 507 of barrel 577. To the left of barrel 577, one of the disks should have an insulating section to decelerate and stop arm 545 for the next firing. Thus, in the device depicted in FIG. 7, the rotation of a single conductive arm 545 sandwiched between conductive disks 513 and 519 serves to effect current flow through parallel rails 501 and 502 and cause the ejection of bullet 571 between them.

The illustrative embodiments herein are merely a few of those possible variations which will occur to those skilled in the art while using the inventive principles contained herein. Accordingly numerous variations of the invention are possible while staying within the spirit and scope of the invention as defined in the following claims.

What is claimed is:

1. A projectile launcher comprising:

first and second parallel spaced apart disks, each disk having a periphery and a hole in its respective center and a gap extending from its said center to its said periphery;

said first disk being made of conductive material and having an inner and outer surface;

said second disk having two portions made of conductive material and having two portions made of insulating material and having an inner and outer surface and having a recess in its said outer surface for holding said projectile;

a rotator having a hub concetric with said first and second disks, said rotator having first and second arms, spaced a fixed angle apart, said first and second arms each being in contact with said inner surfaces of said first and second disks;

said first arm being made of conductive material; and said second arm having a conductive material in contact with said inner surface of said second disk and having insulating material in contact with said inner surface of said first disk so that application of a voltage to said first disk and to a conductive portion of said second disk causes said rotator to rotate and creates oppositely directed parallel currents through said disks and causes said projectile to be ejected.

2. The device of claim 1 wherein said first disk and said conductive portions of said second disk are made of copper.

3. The device of claim 1 wherein said first disk and said conductive portions of said second disk are made of copper-tungsten alloy.

4. The device of claim 1 further including a barrel positioned about said recess in said second disk for guiding said projectile.

5. A projectile launcher comprising:

first and second parallel spaced apart disks, each disk having a periphery and a respective central hole in its respective center and a gap extending from its said center to its said periphery;

said first disk being made of conductive material and having an inner and outer surface;

said second disk having two portions made of conductive material and having two portions made of insulating material and having an inner and outer surface;

both said first and second disks having respective peripheral holes in registration for admitting said projectile;

a rotator having a hub concentric with said first and second disks, said rotator having first and second arms, spaced a fixed angle apart, said first and second arms each being in contact with said inner surfaces of said first and second disks;

said first arm being made of conductive material; and said second arm having conductive material in contact with said inner surface of said second disk and having insulating material in contact with said inner surface of said first disk so that application of a voltage to said first disk and to a conductive portion of said second disk causes said rotator to rotate and creates oppositely directed parallel currents through said disks and causes said projectile to be ejected.

6. A projectile launcher comprising:

first and second parallel spaced apart disks, each said disk having a periphery and a hole in its respective center and a gap extending from its said center to its said periphery;

said first disk being made of conductive material and having an inner and outer surface;

said second disk having two portions made of conductive material and having two portions made of insulating material and having an inner and outer surface, one of said conductive portions being severed by a gap;

two rails, parallel spaced and positioned respectively on each side of said gap;

a rotator having a hub concetric with said first and second disks, said rotator having first and second arms each being in contact with said inner surfaces of said first and second disks;

said first arm being made of conductive material; and said second arm having conductive material in contact with said inner surface of said second disk and having insulating material in contact with inner surface of said first disk so that application of a voltage to said first disk and to a conductive portion of said second disk caused said rotator to rotate and creates oppositely directed parallel currents through said disks and said rails and causes said projectile to be ejected.

* * * * *